US009675860B2

(12) United States Patent
Borsányi

(10) Patent No.: US 9,675,860 B2
(45) Date of Patent: Jun. 13, 2017

(54) MULTI-PURPOSE SPORTS APPARATUS

(71) Applicant: TEQBALL HOLDING S.A.R.L., Luxembourg (LU)

(72) Inventor: Gábor Borsányi, Budapest (HU)

(73) Assignee: TEQBALL HOLDING S.À.R.L., Luxembourg (LU)

( * ) Notice: Subject to any disclaimer, the term of this patent is extended or adjusted under 35 U.S.C. 154(b) by 140 days.

(21) Appl. No.: 14/442,437

(22) PCT Filed: Nov. 13, 2013

(86) PCT No.: PCT/HU2013/000107

§ 371 (c)(1),
(2) Date: May 13, 2015

(87) PCT Pub. No.: WO2014/076515

PCT Pub. Date: May 22, 2014

(65) Prior Publication Data

US 2016/0271469 A1 Sep. 22, 2016

(30) Foreign Application Priority Data

Nov. 14, 2012 (HU) ..... 1200223 U

(51) Int. Cl.
*A63B 69/00* (2006.01)
*A63B 67/04* (2006.01)
(Continued)

(52) U.S. Cl.
CPC ..... *A63B 67/04* (2013.01); *A63B 61/003* (2013.01); *A63B 69/002* (2013.01);
(Continued)

(58) Field of Classification Search
CPC ... A63B 67/04; A63B 69/002; A63B 69/0097; A63B 61/003; A63B 2043/001;
(Continued)

(56) References Cited

U.S. PATENT DOCUMENTS 2,632,546 A * 3/1953 Mott ..... G07F 17/38 194/242
4,421,318 A * 12/1983 Sverdlik ..... A63B 69/0097 473/476

(Continued)

FOREIGN PATENT DOCUMENTS

DE 203 01 215 U1 4/2003
FR 2 606 653 A1 5/1988

(Continued)

*Primary Examiner* — Raleigh W Chiu
(74) *Attorney, Agent, or Firm* — Jason D. Voight

(57) ABSTRACT

The subject of the utility model is a multi-purpose sports apparatus particularly for improving footballers' technical skills, comprising a foundation body (10) containing a playing surface (11) and an obstacle element (20). The distinctive feature of the method is that the playing surface (11) of the foundation body (10) looking from the interior of the foundation body (10) has an at least partially convex top surface (15) and the foundation body (10) has a support structure (30) which separates the playing surface (11) from the base (2).

10 Claims, 1 Drawing Sheet

(51) Int. Cl.
*A63B 61/00* (2006.01)
*A63B 43/00* (2006.01)

(52) U.S. Cl.
CPC ..... *A63B 69/0097* (2013.01); *A63B 2043/001* (2013.01); *A63B 2208/12* (2013.01); *A63B 2225/09* (2013.01); *A63B 2225/093* (2013.01); *A63B 2243/0025* (2013.01)

(58) Field of Classification Search
CPC . A63B 69/00; A63B 2208/12; A63B 2225/09; A63B 2225/0093; A63B 2243/0025
See application file for complete search history.

(56) References Cited

U.S. PATENT DOCUMENTS 5,366,427 A * 11/1994 Price, II ..... A63B 69/0097 473/476
5,375,837 A * 12/1994 Moreau ..... A47B 25/003 108/79
5,398,926 A * 3/1995 Skinner ..... A63B 67/04 473/475
5,487,541 A * 1/1996 Dictor ..... A63B 67/04 473/34
5,531,449 A * 7/1996 Denton ..... A63B 69/0097 273/348
5,795,252 A * 8/1998 Crucet ..... A63B 71/022 473/434
6,213,900 B1 * 4/2001 Steyn ..... A63B 69/0097 473/415
6,379,273 B1 * 4/2002 Takacs ..... A63B 67/04 473/473
D517,620 S * 3/2006 Mazloompour ... A63B 69/0097 D21/698
2003/0013561 A1 * 1/2003 Sompolinsky ..... A63B 67/002 473/435
2016/0271469 A1 * 9/2016 Bors nyi ..... A63B 61/003

FOREIGN PATENT DOCUMENTS

GB 25767 A 0/1902
HU 1917 U 12/2000
HU 2188 U 12/2001
HU 222 429 B1 3/2002
WO 99/07447 A1 2/1999

* cited by examiner

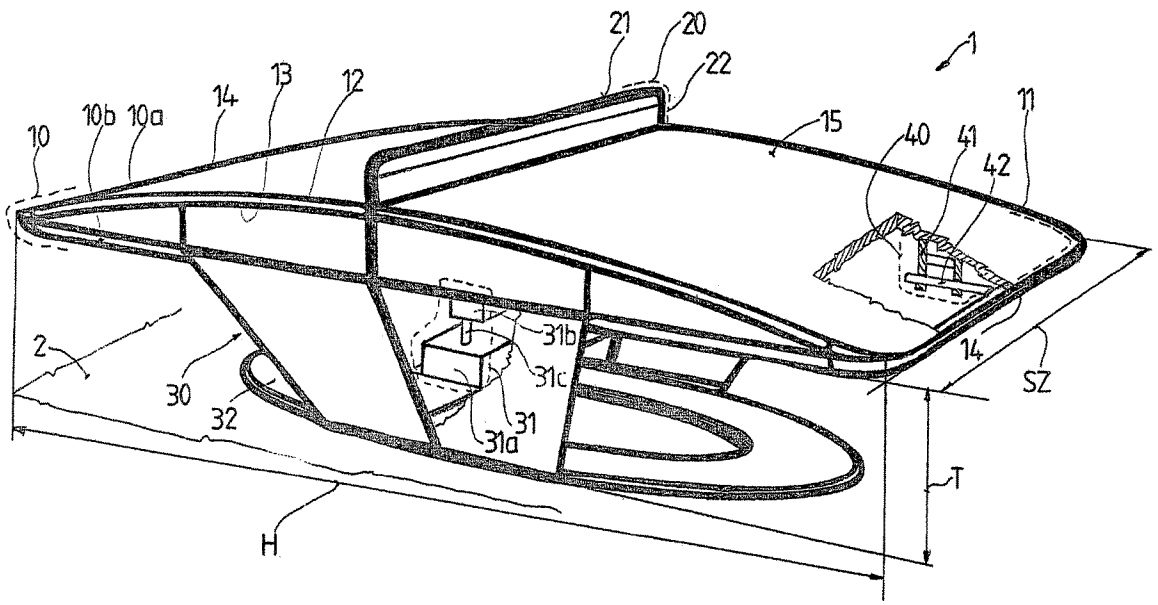
1
11
42
41
40
15
20
22
21
12
13
14
10a
10b
10
SZ
14
T
31b
31c
31
31a
30
32
H
2

MULTI-PURPOSE SPORTS APPARATUS

This is the national stage of International Application PCT/HU2013/000107, filed Nov. 13, 2013.

The subject of the utility model is a multi-purpose sports apparatus, particularly for improving footballers' technical skills, which has a foundation body containing a playing surface and an obstacle element placed on the foundation body.

Many technical devices have been developed for training sportspeople. Among the devices which have been described are aids for polishing technical skills for ball games, including ball control and kicking techniques for football.

Among these skills-improvement devices are those described in the patent of registration number HU 222.643 and the utility model of registration number HU U 2.188. These essentially consist of a vertically-configured target body similar to football goalposts carrying several targets which the player has to hit with the ball. A hit indicator unit evaluates the striking of the targets and displays the results to the player. This arrangement is useful for improving kicking skills, but has the disadvantages of not requiring intensive movement and of requiring substantial free space for the player if the shots are to be made while in motion.

The specification of the patent of registration number HU 222.429 is for a device which may be used in a game similar to football. The apparatus comprises an enclosure and a depression in the central part of the casing to receive the ball. The specification of the utility model of registration number HU U 1.917 describes skills game to be played with a ball which must be rolled into holes placed in an area surrounded by posts similar to the board game Rex. This arrangement is suitable for a small game as a practice, and also requires substantial free space. A further disadvantage is that these games do not require the player to engage in intensive movement with frequent changes of place, and so do not improve stamina.

The method of this utility model has the purpose of eliminating the deficiencies of known football skills improvement devices and to implement a sports apparatus which may be used in a small area, requires the person using it to move with frequent changes of place and position, and demands excellent ball control and kicking technique. Where these skills are deficient, it should substantially improve them in the course of play.

The design of the utility model was arrived at from the realisation that the foregoing purpose may be fulfilled if the top surface of a table-tennis-table-like structure is formed with a curvature deviating from the usual range and a playing area of unusual dimensions, and the carrier base is placed at the appropriate height from the ground, then a ball impinging on the playing surface will in every case bounce outwards from the space occupied by the sports apparatus and so the person using it, by appropriate movement, can in every case reach the ball with his foot or head without the sports apparatus causing any inhibiting or disturbing obstruction.

In accordance with the objective, the utility model is a multi-purpose sports apparatus, particularly for improving footballers' technical skills, comprising a foundation body (10) containing a playing surface (11) and an obstacle element (20) placed on the foundation body (10), wherein the playing surface (11) of the foundation body (10) looking from the interior of the foundation body (10) has an at least partially convex top surface (15) and the foundation body (10) has a support structure (30) which separates the playing surface (11) from the base (2).

Another criterion of the sports apparatus of the utility model may be that the radius of curvature of the convex top surface is between 300 and 2000 cm.

In a different version of the sports apparatus, the convex top surface comprises a cylindrical enclosure consisting of a single curve or the convex top surface comprises a spatial curve consisting of several curved sections.

In yet another form of the model, the separation of the lowest point of the top surface of the foundation body from the base supporting the sports apparatus is between 45 and 75 cm. The width of the perpendicular projection of the top surface on the base supporting the sports apparatus is between 130 and 180 cm, while the length of the perpendicular projection is between 270 and 330 cm.

In another implementation of the sports apparatus, the support structure has an additional height-adjustment unit which has one connecting body fastened to the support structure and another connecting body joined to the foundation body containing the playing area, and an actuator component interposed between one connecting body and the other connecting body.

In a further construction of the model, the foundation body has an upper member fitted with the top surface containing the playing area and a lower member placed under the upper member, where the upper member is made at least partially of flexible material and the lower member of rigid material, and a curvature adjustment mechanism to change the curvature of the upper member is interposed between the upper and lower members.

In yet another version of the sports apparatus, the area covered by the lower part of the support structure contacting the base is less than the area bounded by the perpendicular projection of the foundation body on the base supporting the sports apparatus.

It may be beneficial for the model if the obstacle element is made of rigid material and if the obstacle element is accompanied with a spacing adjustment component to adjust the distance between the upper edge of the obstacle element and the convex top surface of the upper member of the foundation body.

The greatest benefit deriving from the special design of the sports apparatus of the utility model is that on a small area, possibly even indoors, and involving considerable bodily movement, the persons using it may perform activities involving ball handling and targeted return kicks. These activities will gradually develop their stamina, speed, ball sensitivity and ball control. Furthermore, it develops concentration, rapid situation appraisal and decision-making.

Also among the advantages is that the sports apparatus of the model, in addition to its utility as a device for improving skills, provides an enjoyable game for people who like football tennis, with the difference that this apparatus permits a similar game to be played on a much smaller area.

Also among the advantages is that the sports apparatus of the model may be made and assembled using simple tools and known manufacturing technology, so that its production cost may be kept low. Also beneficial is that the sports apparatus does not demand special maintenance. A further advantage deriving from the foregoing is that with modest expenditure it is possible to acquire a long-lasting aid for training and playing.

The sports apparatus of the model has the further advantage that it can be erected and dismantled easily and without special expertise, and thus it may easily be transferred from one site to another, and so the location of skills improvement may easily be changed.

It is important to note that the sports apparatus of the model may be made in such a way that the trajectory and speed of the ball bouncing from the playing area can be changed, so that the same sports apparatus may be used by both adults and children. This involves only the adjustment to the desired extent of the height of the playing area and, where necessary, the curvature of the top surface of the playing area.

The following is a detailed description of the sports apparatus of the utility model for one version of implementation, on the basis of a drawing. On the drawing of the FIGURE, there is a possible version of the sports apparatus of the utility model, partly in cross-section.

The FIGURE shows a version of the sports apparatus 1 of the utility model on which the main physical characteristics in terms of playing the game may be adjusted. Note that the sports apparatus 1 has a support structure 30 placed on the base 2 and has a foundation body 10 held by support structure 30. This version of the foundation body 10 also has an upper member 10*a* and a lower member 10*b*. The upper member 10*a* contains the playing area 11, whose external side 12 opposite the base 2 has a convex top surface 15. On the convex top surface 15 is the obstacle element 20, which is a plate-like body made of an appropriately rigid, preferably transparent material and whose task is to divide the playing area 11 into two halves and prevent the ball (which is not shown on the FIGURE) from simply rolling over the convex top surface 15 of the foundation body 10. In order to permit the height of the obstacle element 20 to be adjusted, the spacing adjuster component 22 is assigned to the obstacle element 20. The spacing adjuster component 22 rests on the convex top surface 15 of the upper member 10*a* of the foundation body 10 so that it also supports the obstacle element 20. The upper edge 21 of the obstacle element 20 may by means of the spacing adjuster component 22 be raised or lowered relative to the convex top surface 15. In the simplest case, the spacing adjuster component 22 is a rod projecting from the convex top surface 15 and having slots one under the other on its side, so that the obstacle element 20 may fit into one of these slots.

The upper member 10*a* is made from plywood treated by a suitable timber industry process and may be bowed into a curve within certain limits. By contrast with the material of the upper member 10*a*, the lower member 10*b* of the foundation body 10 is made of rigid material and this lower member 10*b* essentially connects the upper member 10*a* of the foundation body 10 with the support structure 30.

The radius of curvature of the convex top surface 15 of the upper member 10*a* should be between 300 and 2000 cm. In the present case, the radius of curvature of the convex top surface 15 may be changed within the limits using the curvature adjustment mechanism 40. The curvature adjustment mechanism 40 in this version comprises the connection pieces 41 fastened to the upper member 10*a* and the tensioning mechanism 42. One connection piece 41 is placed near each shorter edge 14 of the upper member 10*a* and fastened to the inner side 13 of the upper member 10*a* and runs parallel to each shorter edge 14 of the upper member 10*a*. The tensioning mechanism 42 is placed between connection pieces 41 and consists in this case of several threaded rods placed side by side and linked to the lower member 10*b* of the foundation body 10.

The length L of foundation body 10 should be between 270 and 330 cm, and in the present case is 300 cm. The width W of foundation body 10 should be between 130 and 180 cm, and in this version is 140 cm. The spacing S between the lowest point of the convex top surface 15, which in this case is that part of the convex top surface 15 at the shorter edge 14, and base 2 may be between 45 and 75 cm. In the present version, this distance may also be adjusted using height adjustment unit 31 of support structure 30.

The height adjustment unit 31 comprises connecting body 31*a* and connecting body 31*b*, with actuator component 31*c* arranged between them. One of the connecting bodies 31*a* of height adjustment unit 31 rests on the lower part 32 of support structure 30, while the other connector body 31*b* of support structure 30 connects to the lower member 10*b* of foundation body 10. The actuator component 31*c* is a hydraulic cylinder which can be actuated manually to continuously alter the spacing S between foundation body 10 and base 2. It is advantageous to make spacing S adjustable so that the convex top surface 15 of the playing area 11 may be lowered to enable smaller persons, such as children, to play the game. It should be noted that the height adjustment unit 31 is not the only means of adjusting the spacing between foundation body 10 and base 2. Another version is conceivable, in which the height of support structure 30 is constant but several support structures 30 of different heights are available, and the spacing S between base 2 and foundation body 10 may be set by exchanging the whole support structure 30.

The FIGURE also shows that the lower part 32 has been designed so that the whole of the foundation body is within the perpendicular projection outline of base 2. This means that the support structure 30 does not disturb the users even if the ball, impinging with low energy on the convex top surface 15 of the upper body 10*a* of the foundation body 10, only bounces to a short distance from the convex top surface 15 to the area outside the foundation body 10.

To use the sports apparatus 1 of the utility model, the desired spacing S between the foundation body 10 and the base 2 is set using the height adjusting unit 31 of the support structure 30. For this, by pumping the actuator component 31*c*, the foundation body 10 and thus the convex top surface 15 of the upper member 10*a* may be raised from the lowest spacing S of 45 cm from the base 2 up to a maximum of 75 cm from the base 2.

Then the radius of curvature of the convex top surface 15 may be adjusted. This involves rotating the tensioning mechanism 42 of the curvature adjustment mechanism 40 so that the shorter edges 14 of upper member 10*a* of the foundation body 10 become closer or further away from each other. When the shorter edges 14 move closer to each other, the radius of curvature of the convex top surface 15 decreases. When the shorter edges 14 move away from each other, the radius of curvature of the convex top surface 15 increases. A longer radius of curvature reduces the bounce of the ball from the convex top surface 15, and a shorter radius of curvature causes the ball to bounce further from the foundation body 10.

After making the adjustments, the persons using the sports apparatus 1 arrange themselves opposite the shorter edges 14 of the foundation body 10 and one person in accordance with the rules of the game kicks the ball so that it bounces on of the playing area 11 of the foundation body 10 on the part which is separated by the obstacle element 20 from the player who kicked the ball. The ball bouncing upwards and outwards from the convex top surface 15 of the foundation body 10 is returned by the other person using his or her foot or head in such a way that the ball flies over the obstacle element 20 and bounces on the other side of the convex top surface 15 of the foundation body 10. The rally continues until one player mis-returns the ball, which bounces on playing area 11 on the part between the player and the obstacle element 20 or does not impinge on the convex top surface 15 of the foundation body 10 at all.

The sports apparatus of the utility model is of use in all cases where it is desired, by means of an enjoyable game involving intensive movement and on a small area, to develop ball control and ball direction, increase strength and improve concentration, rapid appraisal skills and decision-making ability.

The invention claimed is:

1. A multi-purpose sports apparatus comprising a foundation body (10) containing a playing surface (11) and an obstacle element (20) placed on the foundation body (10), wherein the playing surface (11) of the foundation body (10) looking from the interior of the foundation body (10) has an at least partially convex top surface (15) and the foundation body (10) has a support structure (30) which separates the playing surface (11) from the base (2), and wherein the foundation body (10) has an upper member (10*a*) fitted with the top surface (15) containing the playing area (11) and a lower member (10*b*) located under the upper member, where the upper member is made at least partially of flexible material and the lower member of rigid material, and furthermore a curvature adjustment mechanism (40) to change the curvature of the upper member is interposed between the upper member (10*a*) and the lower member (10*b*).

2. The sports apparatus of claim 1, wherein the radius of curvature of the convex top surface (15) is between 300 and 2000 cm.

3. The sports apparatus of claim 1, wherein the convex top surface (15) comprises a cylindrical shell section consisting of a single curve.

4. The sports apparatus of claim 1, wherein the convex top surface (15) comprises a spatial curve consisting of several curved sections.

5. The sports apparatus of claim 1, wherein the separation (T) of the lowest point of the top surface (15) of the foundation body (10) from the base supporting the sports apparatus (1) is between 45 and 75 cm.

6. The sports apparatus of claim 1, wherein the width (SZ) of the perpendicular projection of the top surface (15) on the base (2) supporting the sports apparatus (1) is between 130 and 180 cm, while the length (H) of the perpendicular projection is between 270 and 330 cm.

7. The sports apparatus of claim 1, wherein the support structure 30 has an additional height adjustment unit (31) which has a first connecting body (31*a*) fastened to the support structure (30) and another connecting body (31*b*) attached to the foundation body (10) containing the playing area (11), and an actuator component (31*c*) interposed between the first connecting body (31*a*) and the other connecting body (31*b*).

8. The sports apparatus of claim 1, wherein the area covered by a lower part (32) of the support structure (30) contacting the base (2) is less than the area bounded by the perpendicular projection of the foundation body (10) on the base (2) supporting the sports apparatus (1).

9. The sports apparatus of claim 1, wherein the obstacle element (20) is made of rigid material.

10. The sports apparatus of claim 9, wherein the obstacle element (20) is accompanied with a spacing adjuster component (22) to adjust the distance between the upper edge (21) of the obstacle element (20) and the convex top surface (15) of the upper member (10*a*) of the foundation body (10).

* * * * *